United States Patent [19]

Wallace

[11] 4,091,954

[45] May 30, 1978

[54] ALUMINUM CONTAINER HAVING INTERIOR SURFACE TREATED TO SUPPRESS FOAMING AND METHOD THEREFOR

[75] Inventor: Paul F. Wallace, New Kensington, Pa.

[73] Assignee: Aluminum Company of America, Pittsburgh, Pa.

[21] Appl. No.: 802,634

[22] Filed: Jun. 2, 1977

[51] Int. Cl.[2] ..... B65D 25/14

[52] U.S. Cl. ..... 220/470; 148/6.16; 148/6.27; 426/131; 426/323; 426/398; 427/239; 427/417; 428/35

[58] Field of Search ..... 426/322, 323, 324, 398, 426/329, 131, 126; 220/64; 427/239, 417; 148/6.16, 6.27; 428/35

[56] References Cited

U.S. PATENT DOCUMENTS

| | | | |
|---|---|---|---|
| 3,706,604 | 12/1972 | Plaxton | 148/6.16 |
| 3,912,548 | 10/1975 | Faigen | 427/409 X |

*Primary Examiner*—Steven L. Weinstein
*Attorney, Agent, or Firm*—John P. Taylor; Andrew Alexander

[57] ABSTRACT

An aluminum container has an inner surface treated to suppress foaming of carbonated liquids subsequently placed therein by first chemically cleaning the aluminum surface, forming a conversion coating on the surface using a solution containing ions of phosphate, hexavalent chromium and fluoride; and treating the coated aluminum surface with an aqueous solution containing glycerol.

5 Claims, 1 Drawing Figure

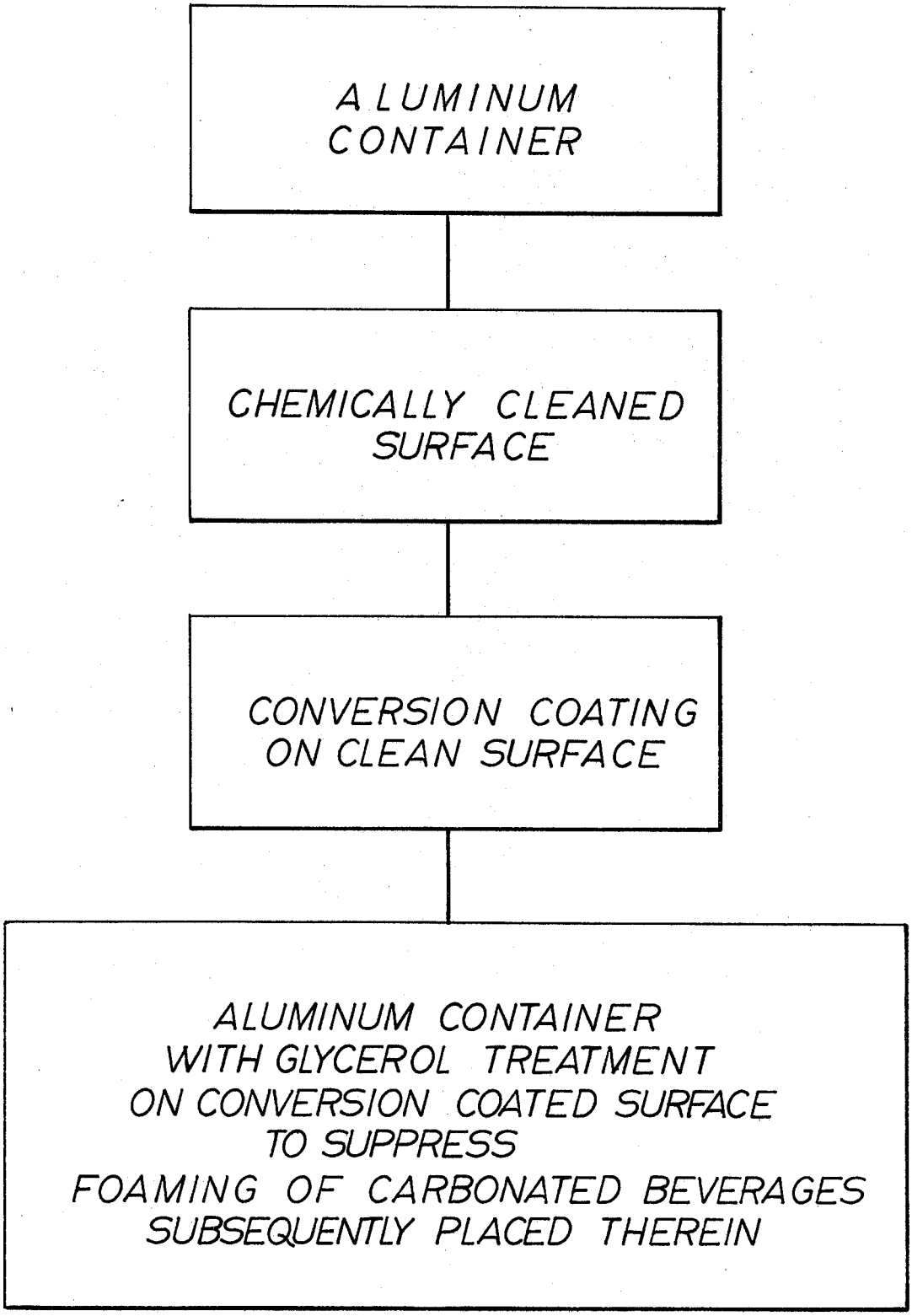
ALUMINUM CONTAINER
CHEMICALLY CLEANED SURFACE
CONVERSION COATING ON CLEAN SURFACE
ALUMINUM CONTAINER WITH GLYCEROL TREATMENT ON CONVERSION COATED SURFACE TO SUPPRESS FOAMING OF CARBONATED BEVERAGES SUBSEQUENTLY PLACED THEREIN

ALUMINUM CONTAINER HAVING INTERIOR SURFACE TREATED TO SUPPRESS FOAMING AND METHOD THEREFOR

BACKGROUND OF THE INVENTION

This invention relates to aluminum containers. More particularly, this invention relates to an aluminum container having an inner surface treated to suppress foaming of carbonated liquids subsequently placed therein.

Aluminum containers used in the food and beverage industry are normally coated with organic lacquers or paints, i.e. organic coating materials capable of curing to form an adherent continuous film on the surface. To obtain proper adherence of such organic materials to the aluminum, it is customary to first clean the surface of the aluminum and then to apply an inorganic coating material known in the trade as a conversion coating. This involves treating the surface with a solution containing ions of phosphate, hexavalent chromium, and fluoride. The organic coating is then applied thereon.

It has been found that this conversion coating actually provides, from a biological standpoint, a satisfactory coating without the need for further application of organic coating materials. This, of course, results in considerable savings. However, when a container having only such a conversion coating on its surface is subsequently filled with a carbonated liquid such as beer or the like, the liquid has been found to excessively foam, thus interfering with the filling operation and reducing the carbonation and resultant foamability of the liquid when later poured into a glass or the like.

Quite surprisingly, I have discovered that an aluminum container which has been treated to form a conversion coating theron can be further treated to suppress subsequent foaming of carbonated liquids therein.

SUMMARY OF THE INVENTION

In accordance with the invention, an aluminum container having an inner surface treated to provide a protective coating thereon which will suppress foaming of carbonated liquids subsequently placed therein comprises: a chemically cleaned inner surface of the container reacted with a solution containing ions of phosphate, hexavalent chromium, and fluoride to form a conversion coating on the aluminum and treated with an aqueous solution containing glycerol.

BRIEF DESCRIPTION OF THE DRAWING

The sole drawing of the invention is a flowsheet illustrating the process of the invention.

DESCRIPTION OF THE INVENTION

In forming the container of the invention, the aluminum container is first cleaned to remove rolling lubricants, aluminum fines, oxide particles or any other foreign materials. Various cleaning agents can be used, however, a hot alkaline cleaning solution is preferred. Typical of such an alkaline cleaning solution would be one containing 3–5% by weight tetrasodium pyrophosphate as the cleaning agent together with 0.1–0.2% of sodium gluconate to complex with any dissolved aluminum and prevent it from precipitating from the cleaning solution as a sludge. Minor amounts (0.1–0.2%) of a wetting agent (such as Wyandotte Pluronic L61) as well as a suitable emulsifier to increase the oil-carrying capacity of the solution (for example, Atlas IL275) are also desirably used.

The aluminum container is preferably cleaned with the cleaning solution at an elevated temperature of about 160–180° F for a period of from about 1–5 seconds (although longer contact time may be used if deemed necessary).

The cleaned aluminum container is now provided with a conversion coating in the range of 215–375 milligrams/meter$^2$ using a solution containing phosphate hexavalent chromium, and fluoride ions such as described in Formula 2 of U.S. Pat. No. 3,912,548. Preferably, such a treating solution contains 28–30 grams/liter of phosphate ion, 4–6 grams/liter of hexavalent chromium ion, and 1.5–2.5 grams/liter of fluoride ion in water. At a temperature of 110° F this solution forms a complex conversion coating on the aluminum container at a rate of approximately 43 milligrams/meter$^2$ per second.

The solution can be prepared by preparation and mixing together of two concentrated stock solutions as follows:

Solution A — 451 milliliters per liter of phosphoric acid (85% $H_3PO_4$) and 224 grams/liter of chromic acid ($CrO_3$) in deionized water.

Solution B — 303 grams/liter of ammonium bifluoride ($NH_4HF_2$) in deionized water.

The conversion coating solution is then prepared using 4.4% by volume of Solution A and 1% by volume of Solution B in deionized water. The conversion coating solution should be heated to 100°–120° F and applied as either a spray or by pouring the solution into a container allowing about 5–10 seconds contact time for the proper thickness of coating (215–375 milligrams/meter$^2$).

Following this conversion coating, the metal strip is thoroughly rinsed with water to remove unreacted coating solution. The rinsing must be sufficient to remove all traces of hexavalent chromium from the surface of the metal strip. If necessary, the final deionized rinse water may be heated slightly (to about 35° C) to aid in the removal of the hexavalent chromium.

The conversion coated aluminum container is now subjected to the final step of the invention, i.e. treatment with glycerol (1,2,3 propanetriol). The glycerol is applied to the conversion coated aluminum surface at a strength which may range from 1% by volume glycerol in deionized water up to pure glycerol. The glycerol may be maintained at room temperature. The treatment is made for a period of from 10 seconds to 2 minutes. Since the glycerol is relatively nontoxic and tasteless, no further rinsing is necessary.

To further illustrate the invention, three 12-ounce aluminum containers were prepared. Each of the containers was cleaned and conversion coated in accordance with the procedures discussed above. However, one container was then coated with a modified polyester organic coating. A second container was treated with glycerol in accordance with the invention. Seven ounces of chilled beer (about 1° C) were poured gently into each of the three cans. The can coated only with the conversion coating formed approximately 5 centimeters of foam. The can with the organic coating formed a head of about 0.2 centimeters of foam. The container having the glycerol coating in accordance with the invention formed no measurable foam head thereon. After standing for about 2 hours at room temperature, the beer was poured rapidly from each container. The beer from the container having only a conversion coating thereon was flat. That from the other two containers both formed substantial heads.

Having thus described the invention, what is claimed is:

1. An aluminum container having an inner surface treated by first chemically cleaning the inner surface, then reacting the inner surface with a solution containing ions of phosphate, hexavalent chromium, and fluoride to form a conversion coating on the aluminum, and finally treating the conversion coated aluminum surface with an aqueous solution containing glycerol such that the inner surface is provided with a glycerol coating which will suppress foaming of carbonated liquids subsequently placed in said container.

2. The container of claim 1 wherein the aqueous solution contains at least 1% by volume glycerol.

3. The container of claim 2 wherein the aqueous solution of glycerol is applied to the inner surface of the aluminum container at room temperature for a period of from 10 seconds to 2 minutes.

4. The container of claim 3 wherein the conversion coating thickness ranges from 215–375 milligrams per meter$^2$.

5. A process for treating the inner surface of an aluminum container to provide a protective coating thereon which will suppress foaming of carbonated liquids subsequently placed therein which comprises:

(a) chemically cleaning the inner surface of the container;

(b) reacting the inner surface with a solution containing ions of phosphate, hexavalent chromium, and fluoride to form a conversion coating on the aluminum; and (c) treating the conversion coated aluminum surface with an aqueous solution containing glycerol such that the inner surface is provided with a glycerol coating which will suppress foaming of carbonated liquids subsequently placed in said container.

* * * * *